US006533526B2

(12) United States Patent
Lindgren et al.

(10) Patent No.: US 6,533,526 B2
(45) Date of Patent: Mar. 18, 2003

(54) FORK LIFT RACK DISPLACEMENT DEVICE

(75) Inventors: Gunnar Lindgren, Eskilstuna (SE); Daniel Back, Eskilstuna (SE); Håkan Ripell, Skogstorp (SE)

(73) Assignee: Volvo Wheel Loaders AB, Eskilstuna (SE)

( * ) Notice: Subject to any disclaimer, the term of this patent is extended or adjusted under 35 U.S.C. 154(b) by 0 days.

(21) Appl. No.: 09/682,492

(22) Filed: Sep. 7, 2001

(65) Prior Publication Data

US 2002/0025247 A1 Feb. 28, 2002

Related U.S. Application Data

(63) Continuation of application No. 09/284,078, filed as application No. PCT/SE97/01673 on Oct. 7, 1997, now Pat. No. 6,287,073.

(30) Foreign Application Priority Data

Oct. 7, 1996 (SE) ..... 9603655

(51) Int. Cl.[7] ..... B66F 1/14

(52) U.S. Cl. ..... 414/667; 414/671; 414/607; 414/785; 187/237

(58) Field of Search ..... 414/785, 622, 414/663, 664, 667, 668, 671, 607; 187/222, 237

(56) References Cited

U.S. PATENT DOCUMENTS

| | | | | |
|---|---|---|---|---|
| 3,429,470 A | * | 2/1969 | Melin | 414/785 |
| 4,024,973 A | * | 5/1977 | Siderits et al. | 414/785 X |
| 4,342,377 A | * | 8/1982 | Goodwin | 414/785 X |
| 5,338,148 A | * | 8/1994 | Rönnblom | 414/667 |

* cited by examiner

*Primary Examiner*—Frank E. Werner
(74) *Attorney, Agent, or Firm*—Howrey Simon Arnold & White LLP

(57) ABSTRACT

This invention relates to a displacement device mountable on a fork lift rack for allowing displacement of a lift member in a substantially vertical direction. The displacement device has a body with at least one elongated opening having its longitudinal direction in the vertical direction, a pin moveably received in the opening, and at least one coupler for connecting to the fork lift rack. A coupler of the fork lift member can be connected to the pin. Accordingly, the lift members can be inserted under an object that is placed on an inclined surface without having to tip the entire fork lift rack.

14 Claims, 5 Drawing Sheets

FORK LIFT RACK DISPLACEMENT DEVICE

CROSS REFERENCE TO RELATED APPLICATIONS

The present application is a continuation application Ser. No. 09/284,078 filed on May 6, 1999 of U.S. Pat. No. 6,287,073, issued Sep. 11, 2001, which was a National Stage filing under 35 U.S.C. §371 of International Application No. PCT/SE97/01673, filed Oct. 7, 1997, which claims priority to Swedish Application No. 9603655-3, filed Oct. 7, 1996.

BACKGROUND OF INVENTION

1. Technical Field

The present invention relates to a fork lift rack. More specifically, the invention relates to displacement device for the fork members of the fork lift rack whereby the fork members are displaceable relative to the displacement device.

2. Background Information

Fork lift racks are known in the art and are used to fix the forks at a predetermined distance from each other. The fork lift rack typically comprises an anchor or anchoring means that makes it possible to fix the fork lift rack to the lift mechanism of, e.g., a wheel loader or a fork lift truck. In order to adjust the fork members to various objects to be lifted, the fork members are laterally displaceable along the fork lift rack.

However, when such a known fork lift rack is mounted on the lift mechanism of a wheel loader, the upper and lower beams of the fork lift rack block the sight of the operator, making it difficult for him to aim at and then insert the fork members under the object to be lifted, as well as place the object at its intended location. If the distance set between the fork members is small, the upright sections of the fork members also block the sight of the operator.

A fork lift rack is repeatedly placed under varying loads, subjecting the material in the fork lift rack to metal fatigue. The risk is greatest for fatigue cracking at the joints between the beams and the spacers.

SUMMARY OF INVENTION

The present invention provides a displacement device for a fork lift rack and a fork member that gives a large field of vision for an operator when the fork lift rack is mounted on the lift mechanism of the vehicle. The displacement device further provides a means whereby the fork members can be inserted under an object that is placed on an inclined surface without having to tip the entire fork lift rack.

The present invention further provides a fork lift rack which has high fatigue strength.

A further purpose of the present invention is to provide a fork lift rack that permits the loading and unloading of an object on an inclined surface. This is achieved according to the invention by a web and a flange on the upper beam that are joined to each other at an angle $\alpha$ differing from 90°. The upper beam is joined to one or more spacer elements via the web, with the web being directed away from the lower beam. By making the web of the first beam inclined, the flange will be displaced downwards towards the lower beam. This means that the operator will be better able to see the fork members mounted on the rack when the lift mechanism is in its lower position.

According to one embodiment of the present invention, the fork members are displaceable relative to a displacement device that connects the fork members to the fork lift rack, permitting loading and unloading on inclined surfaces.

BRIEF DESCRIPTION OF DRAWINGS

The invention will be described in more detail below with reference to examples shown in the accompanying drawings, where.

DETAILED DESCRIPTION

Figure 1:
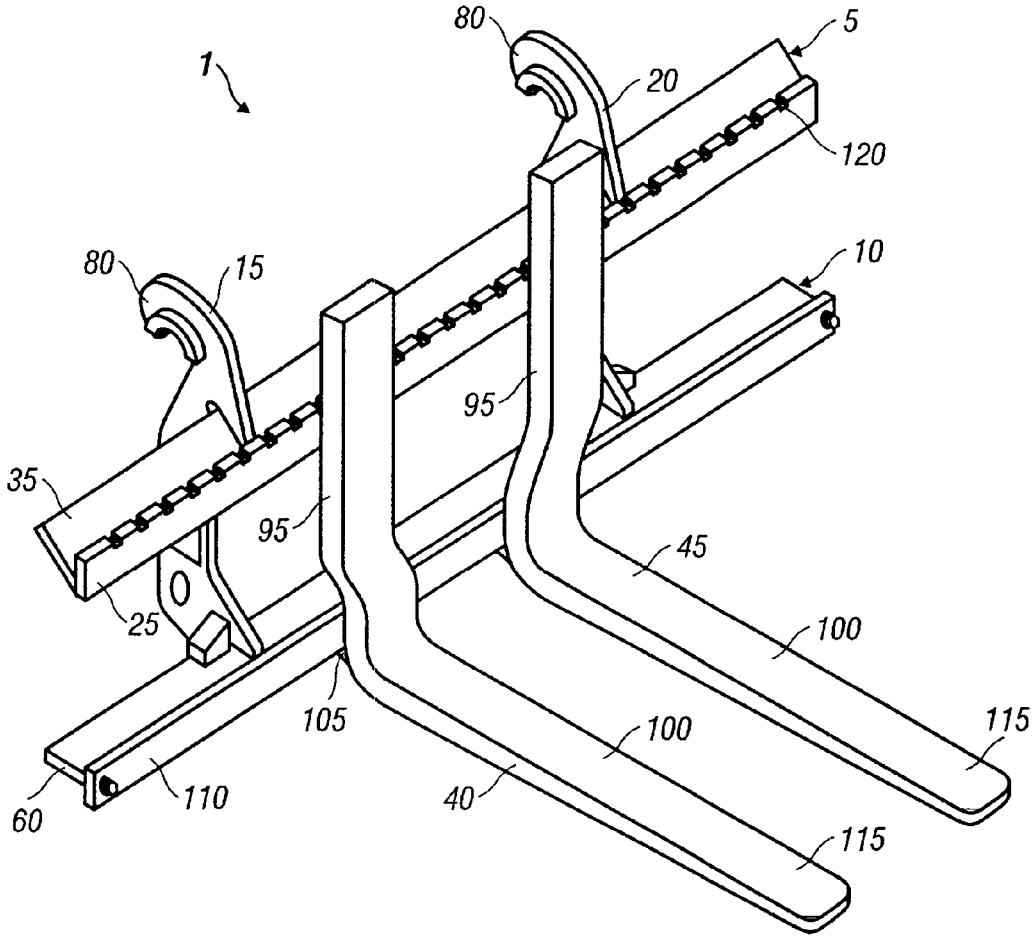
FIG. 1 illustrates a perspective view of a fork lift rack with fork members mounted on the rack.
Figure 2:
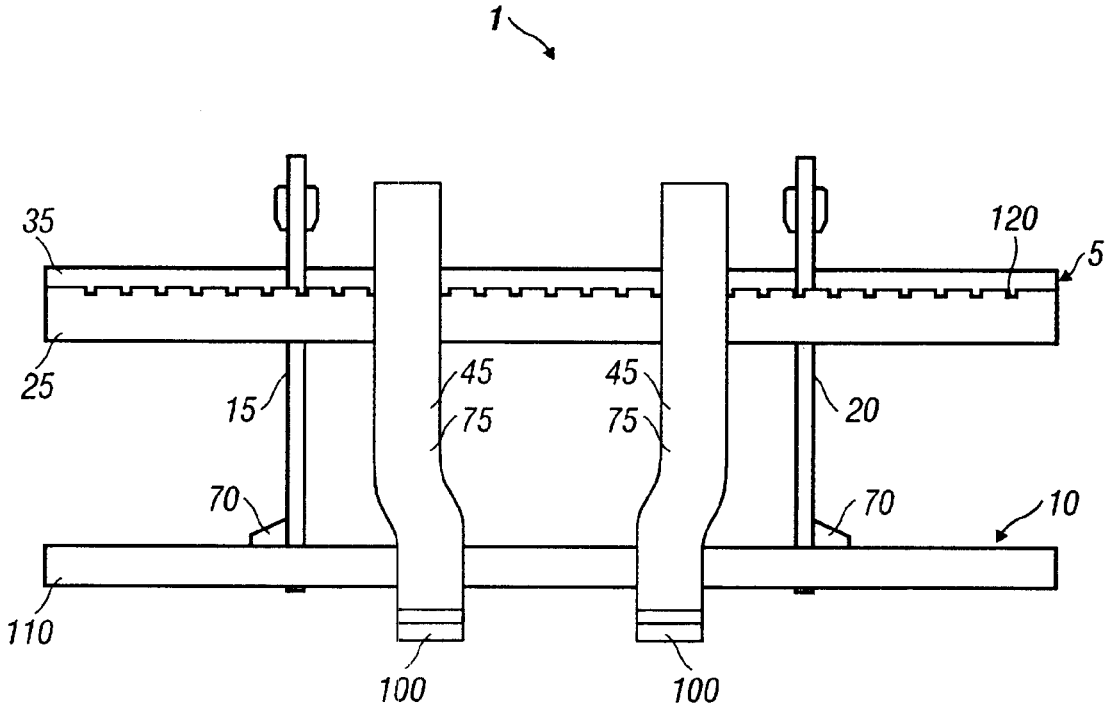
FIG. 2 illustrates a front view of a fork lift rack with fork members mounted on the rack.

FIGS. 1–4 illustrate one embodiment of a fork lift rack 1 having an upper beam 5 and a lower beam 10 that are fixed spaced from and substantially parallel to each other by means of at least two spacer elements 15, 20. The upper beam 5 has a flange 25 provided with a web 35. The lower beam 10 is preferably a T-beam. For strength considerations, it is important that the anchoring points of the upper and lower beams 5, 10 in relation to the respective spacer elements 15, 20 be arranged at a substantial distance from each other. However, this means that the upper beam 5 will limit the field of vision of an operator of the vehicle on which the fork lift rack 1 is mounted. In order to solve this problem, the web 35 of the upper beam 5 is made inclined, which means that the flange 25 will be displaced relative to the second beam 10. The upper beam 5 preferably has a cross-section substantially in a V-shape. This means that the web is joined to the flange 25 of the upper beam 5 at an angle a which is not 90°. Preferably this angle lies in an interval of about 40° to about 50°. The web 35 is directed into the respective spacer elements 15, 20, with the flange 25 free of the respective spacer elements 15, 20.

By virtue of the fact that the flange 25 is displaced towards the lower beam 10, the field vision of the operator is increased. The operator is provided with a larger overview of the fork members 40, 45 mounted on the fork lift rack 1, making it easier for the operator to direct the fork members 40, 45 under the object to be lifted, and place the object where it is to be left.

Figure 3:
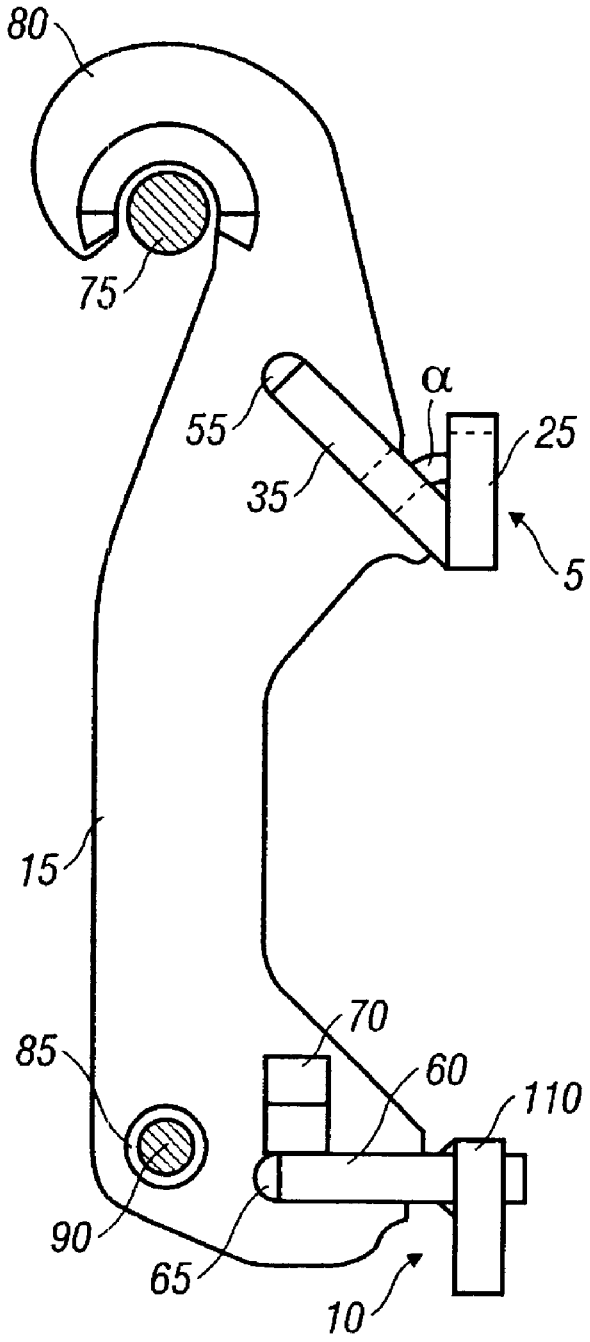
FIG. 3 illustrates a side view of a fork lift rack.
Figure 4:
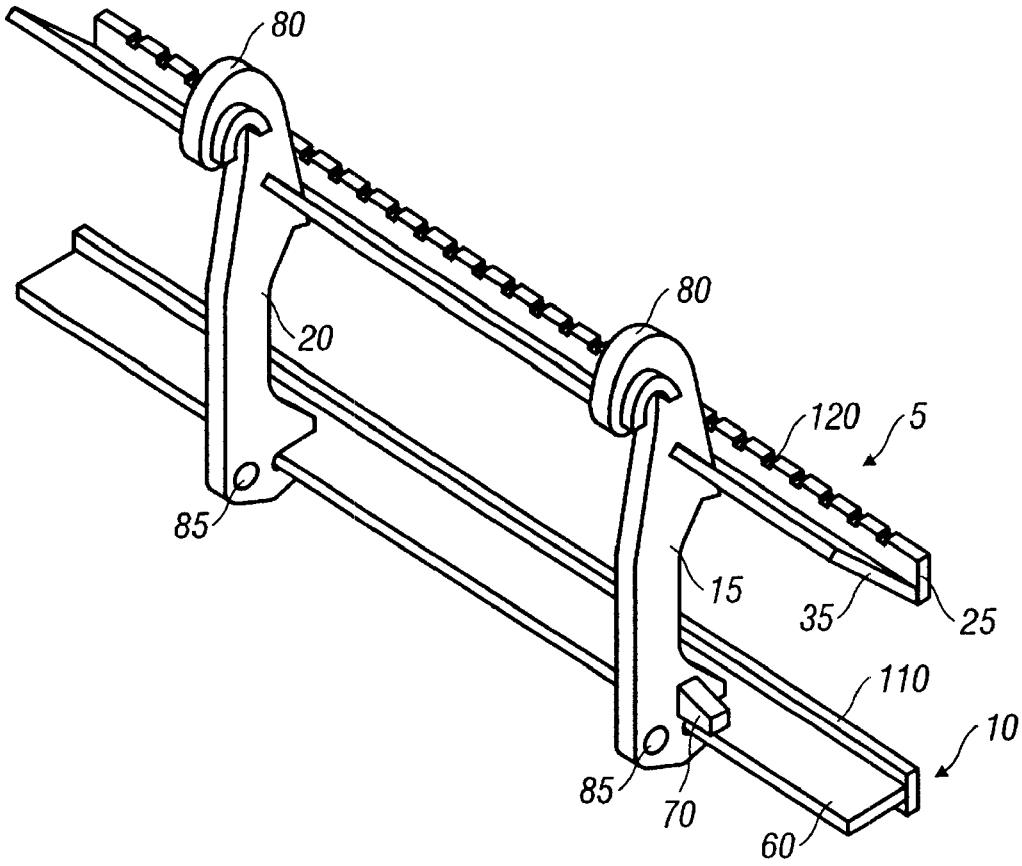
FIG. 4 illustrates a perspective view of a fork lift rack.

As can best be seen in FIGS. 3 and 4, the upper beam 5 is joined to the respective spacer elements 15, 20 by means of the web 35. The web 35 of the upper beam 5 is inserted into a slot 55 in each spacer element 15, 20. This joint provides high fatigue strength in the joint between the upper beam 5 and the spacer elements 15, 20. The fatigue strength can be increased further by rounding the bottom of the slot 55.

The web 35 of the upper beam 5 thus extends obliquely upwards towards the hook 80, and the flange 25 of the upper beam 5 extends substantially in a vertical plane. The 'vertical plane' in this context means the plane perpendicular to a horizontal surface on which there rests, for example, a pallet to be lifted by means of the fork lift rack.

The lower beam 10, which as illustrated is made as a T-beam, has a web 60 that is joined to the respective spacer elements 15, 20. A second slot 65 is made in each spacer element 15, 20 into which the web 60 is inserted. In order to reduce the stress concentrations, the bottom of the second slot 65 is preferably rounded. A heel 70 is arranged on each spacer element 15, 20 and is joined to both the web 60 and the respective spacer elements 15, 20.

The spacer elements 15, 20 are arranged at a substantial distance from each other and form, together with the upper and lower beam 5, 10, a frame. The distance between the spacer elements 15, 20 is also dependent on the design of the lifting mechanism 75 to which the fork lift rack 1 is to be coupled.

Referring to FIG. 3, each spacer element 15, 20 comprises an attachment means or connector in the form of a hook 80 and an opening 85. The hook 80 is designed to be hooked onto a lifting mechanism 75 having a pin 90 designed to be inserted into the opening 85.

As can be seen best in FIG. 1, there are preferably mounted on the fork lift rack 1 two fork members 40, 45, such as pallet fork members, each having first and second legs 95, 100. The first 95 and second 100 legs form substantially a right angle with each other, the first leg 95 having a coupler or coupling means 105 for coupling together with the upper and lower beams 5, 10 of the fork lift rack 1. The coupler or coupling means 105 is joined to the first leg 95 and is coupled to the flange 25 of the upper beam 5. At the same time, the first leg 95 abuts against the flange 110 of the lower beam 10. The second leg 100 has a load or load bearing surface 115 for carrying a load.

In order to lift objects of different shapes, the distance between the fork members 40, 45 can be changed. The flange 25 of the upper beam 5 comprises a plurality of notches 120 along its length. These notches are intended to determine the positions of the fork members 40, 45 and cooperate with the coupling means 105 to laterally fix the fork members 40, 45. For example, if long objects are to be lifted, it is suitable that the distance between the fork members 40, 45 be great in order to distribute the load. Preferably both the upper and lower beams 5, 10 extend laterally to either side of each spacer element 15, 20, making possible a large distance between the fork members 40, 45. If smaller objects are to be lifted, the distance between the fork members 40, 45 can be decreased.

When the distance between the fork members 40, 45 is small, the field of vision of the operator will be limited by the first legs 95 of the fork members 40, 45. In order to solve this problem, the first and second legs 95, 100 extend in separate vertical planes. The fork members 40, 45 are designed such that the distance between the first legs 95 is greater than the distance between the second legs 100 when the two forks are mounted in place on the rack.

Figure 5:
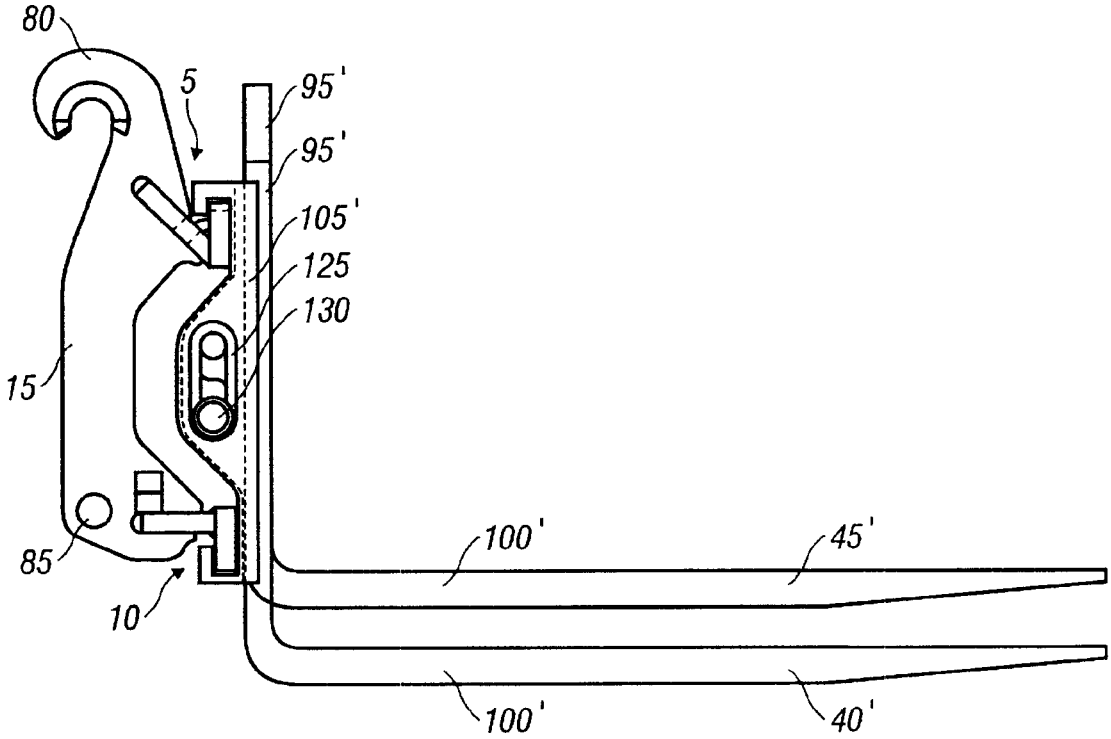
FIG. 5 illustrates a side view of an alternative embodiment of a fork lift rack with fork members mounted on the rack and being displaceable relative to a coupling means.

According to an alternative embodiment illustrated in FIG. 5, an accessory arrangement is disclosed that is interconnected between each of the respective fork members 40', 45' and the fork lift rack. This arrangement permits each fork member 40', 45' to be made displaceable relative to a displacement accommodating means or device in the longitudinal direction of the first leg 95'. In this manner, a body portion 105' of the displacement device is coupled to the upper and lower beams 5, 10 by at least one coupler or coupling means, with the body 105' having at least one elongate opening 125 in which a free-floating pin 130 mounted on the first leg 95' can move. The body 105' can further have at least two, also referred to as a pair of elongate openings 125, wherein at least one is on each side of an intended position for the first leg 95'. The body 105' can further have an elongated guide for receiving the first leg 95'. The guide can have a recess that is connected to at least one elongate opening 125, with the pin 130 located in the recess. The coupling means is moveable along the beams 5, 10. Further, the coupling means can be formed by a hook for detachably connecting to the upper beam 5. This arrangement enables the fork members 40', 45' to be inserted under an object which is placed on an inclined surface without having to tip the entire fork lift rack 1 to the same inclination as the surface. When the fork lift rack 1 with the fork members 40', 45' is lowered against the inclined surface, one of the fork members 40', 45' will strike the surface before the other fork member 40', 45' does. The fork member 40', 45' which first strikes the surface will be displaced relative to the coupling means 105' and, thus, also relative to the fork lift rack 1. When the fork lift rack 1 is lowered further, the other fork member 40', 45' will strike the surface. Thereafter the lowering of the fork lift rack 1 will cease and the fork members 40', 45' will be pushed in under the object to be lifted. FIG. 5 shows the fork members 40', 45' in staggered position. Second legs 100' are also shown in FIG. 5.

Although the present invention has been described and illustrated in detail, it is to be clearly understood that the same is by way of illustration and example only, and is not to be taken as a limitation. The spirit and scope of the present invention are to be limited only by the terms of any claims presented hereafter.

What is claimed is:

1. An accessory arrangement for a fork lift truck adapted to enable relative movement between a plurality of fork members carried on the fork lift truck in a substantially vertical direction, said fork lift truck accessory arrangement comprising:

at least one displacement accommodating means detachably mountable on a fork lift rack of a carrying fork lift truck, said displacement accommodating means configured to be interconnected between a fork lift rack and a fork member and for permitting displacement of the fork member in a substantially vertical direction relative to the fork lift rack in response to an outside force acting on an attached fork member;

a coupling means for detachably connecting said displacement accommodating means to the fork lift rack;

a body portion of said displacement accommodating means having at least one elongate opening that is substantially vertically oriented when said displacement accommodating means is mounted upon the fork lift rack; and a free-floating pin reciprocatingly received in said elongate opening and one of said fork members being attached thereupon and said displacement accommodating means further adapted for permitting said pin to be displaced relative to said fork lift rack in response to an outside force acting on a load carrying portion of said attached fork member.

2. The accessory arrangement for a fork lift truck according to claim 1 further comprising:

said at least one elongate opening in said body portion of said displacement accommodating means being a pair of elongate openings, said pair of elongate openings being spaced apart, one from the other so that when the fork member is attached to said displacement accommodating means, one each of said pair of elongate openings is positioned at opposite sides of a leg of the attached fork member.

3. The accessory arrangement for a fork lift truck according to claim 1 further comprising:

said body portion having an elongated guide adapted for receiving a leg of an attached fork member.

4. The accessory arrangement for a fork lift truck according to claim 3 further comprising:

said elongated guide having a recess connected to the elongate opening and said pin being located in said recess.

5. A fork lift truck adapted to enable relative movement between a plurality of fork members carried on the fork lift truck in a substantially vertical direction, said fork lift truck comprising:

a fork lift truck having a fork lift rack mounted thereupon, said fork lift rack configured to receive at least two laterally spaced apart fork members thereupon;

at least one displacement accommodating means detachably mounted on said fork lift rack of said fork lift truck, said displacement accommodating means interconnected with one of said fork members and arranged for permitting displacement of said fork member that is attached thereto in a substantially vertical direction relative to said fork lift rack in response to an outside force acting on said attached fork member;

a coupling means detachably connecting said displacement accommodating means to said fork lift rack;

a body portion of said displacement accommodating means having at least one elongate opening that is substantially vertically oriented; and a free-floating pin reciprocatingly received in said elongate opening and one of said fork members being attached thereupon and said displacement accommodating means further adapted for permitting said pin to be displaced relative to said fork lift rack in response to an outside force acting on a load carrying portion of said attached fork member.

6. The fork lift truck according to claim 5 further comprising:

said at least one elongate opening in said body portion of said displacement accommodating means being a pair of elongate openings, said pair of elongate openings being spaced apart and arranged so that one each of said pair of elongate openings is positioned at opposite sides of a leg of said attached fork member.

7. The fork lift truck according to claim 5 further comprising:

said body portion having an elongated guide adapted for receiving a leg of an attached fork member.

8. The fork lift truck according to claim 7 further comprising:

said elongated guide having a recess connected to said elongate opening and said pin being located in said recess.

9. The fork lift truck according to claim 5, further comprising:

said fork lift rack having an upper beam adapted to carry said fork members.

10. The fork lift truck according to claim 9, further comprising:

said upper beam being adapted to carry said displacement accommodating means, and each of said displacement accommodating means being adapted to carry a fork member.

11. The fork lift truck according to claim 5 further comprising:

said fork lift rack having an upper beam, a lower beam, and at least two spacers elements for fixing said upper and lower beams at a distance from, and substantially parallel to, one another.

12. The fork lift truck according to claim 11 further comprising:

said coupling means adapted to be moveable along said upper and lower beams of said fork lift rack.

13. The fork lift truck according to claim 11 further comprising:

said coupling means formed as a hook and adapted for detachable connection upon said upper beam.

14. The fork lift truck according to claim 5 further comprising:

said fork member having a first and second leg that form a substantially right angle one to the other; and said first leg being provided with a coupler for affecting a connection upon said fork lift rack, and said second leg having a load surface for carrying a load thereupon.

* * * * *